United States Patent [19]

Phillips

[11] Patent Number: 4,476,079

[45] Date of Patent: Oct. 9, 1984

[54] PROCESS FOR MANUFACTURE OF TEXTILE YARNS

[75] Inventor: Bobby M. Phillips, Kingsport, Tenn.

[73] Assignee: Eastman Kodak Company, Rochester, N.Y.

[21] Appl. No.: 539,867

[22] Filed: Oct. 7, 1983

[51] Int. Cl.[3] ..... B29C 17/02

[52] U.S. Cl. ..... 264/154; 28/273; 264/288.8; 264/290.5; 264/DIG. 47

[58] Field of Search ..... 264/147, 154, 288.8, 264/290.5, DIG. 47; 28/273

[56] References Cited

U.S. PATENT DOCUMENTS

| | | | |
|---|---|---|---|
| 2,924,868 | 2/1960 | Dyer | 28/273 |
| 3,452,130 | 6/1969 | Pitzl | 264/288.8 |
| 4,095,319 | 6/1978 | Nelson | 28/273 |
| 4,251,481 | 2/1981 | Hamlyn | 264/290.5 |
| 4,332,761 | 6/1982 | Phillipp et al. | 264/147 |

*Primary Examiner*—James Lowe

*Attorney, Agent, or Firm*—Malcolm G. Dunn; Daniel B. Reece, III

[57] ABSTRACT

In a process for draw fracturing yarn wherein the yarn is passed through a turbulent flow air suction device downstream of where the yarn is drawn and upstream of an air fracturing jet so that broken filaments extending from the yarn will be intermingled and immobilized by entangling them with unbroken filaments in the yarn so as to reduce yarn breaks.

1 Claim, 2 Drawing Figures

PROCESS FOR MANUFACTURE OF TEXTILE YARNS

DESCRIPTION

1. Technical Field

This invention relates to a novel process improvement useful in the manufacture of continuous filament yarn having a spun yarn character, and in particular it involves the use in a fracturing process of a turbulent flow fluid jet to intermingle and immobilize broken filaments in a yarn in order to minimize the occurrence of yarn breaks due to plugging of broken filaments in the fracturing means.

2. Background Art

U.S. Pat. No. 4,332,761 discloses a process for draw fracturing textile yarn using a feed yarn of fracturable filaments, stabilizing the yarn to a preselected level, fracturing the fracturable filaments and taking up the yarn. In such a process occasionally a broken filament will be stripped back along the yarn and cause an end break as the yarn passes through the fracturing process.

An object of this invention is to provide a process by which trailing ends of broken filaments are intermingled and immobilized, thereby resulting in reduced ends down.

DISCLOSURE OF THE INVENTION

In accordance with the present invention, I provide an improvement in a process for draw fracturing yarn involving uniformly drawing to a preselected level of utility a yarn comprised of a plurality of continuous filaments having a fracturable cross-section, fracturing the filaments by passing the yarn through an operating fluid fracturing jet and taking up the yarn. The improvement involves passing the yarn through a turbulent flow air suction device downstream of the drawing and upstream of the fracturing jet, the air suction device being adjusted to provide suction at the entrance thereof to intermingle and immobilize broken filaments by entangling them with unbroken filaments in the yarn and thereby reduce end breaks in the fracturing operation.

BRIEF DESCRIPTION OF DRAWINGS

The details of my invention will be described in connection with the accompanying drawings, in which.

BEST MODE FOR CARRYING OUT THE INVENTION

Figure 1:
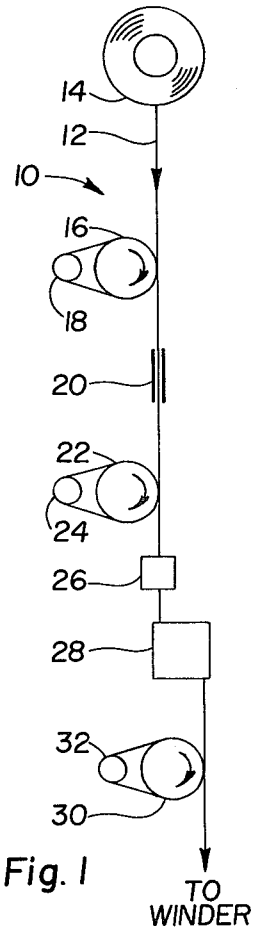
FIG. 1 is a schematic diagram of a process for draw texturing yarn including the use of an air suction device upstream of the fracturing jet.

In reference to FIG. 1 of the drawings, the draw fracturing process is shown at 10. The yarn 12 may be withdrawn from a feed yarn package 14, pass over a godet roll 16 and its separator roll 18, through a yarn heat stabilizing device 20, over a second godet roll 22 and its separator roll 24, through an air suction device 26 to be described, and through an air fracturing jet 28 (such as disclosed in U.S. Pat. No. 4,332,761 above), over a haulout godet roll 30 and its separator roll 32 for subsequent forwarding to a winding device (not shown). The yarn 12 may be suitably drawn between the first and second godet rolls and their respective separator rolls by rotating the second godet roll set faster than the first. The heat stabilizing device 20 may be a slit heater for contact or noncontact with the yarn.

As mentioned above, U.S. Pat. No. 4,332,761 describes a process for draw fracturing textile yarn; therefore the disclosure in that patent is incorporated herein to the extent necessary for a better understanding of my present invention. Reference is also made to U.S. Pat. No. 4,245,001 which is related to U.S. Pat. No. 4,332,761 and which discloses the resulting product of the process patent.

During the course of practicing the process described in the above-mentioned process patent, an occasional broken filament will occur in the yarn at a point prior to the location of the air fracturing jet. When the trailing end reaches the entrance of the air fracturing jet, the counter-current air flow initiates peeling back of the trailing end with a resulting snarl or wad of material quickly forming which will not pass through the small opening; hence the yarn will break. This yarn breakage, of course, necessitates again stringing up the yarn through the fracturing jet and its associated apparatus.

Figure 2:
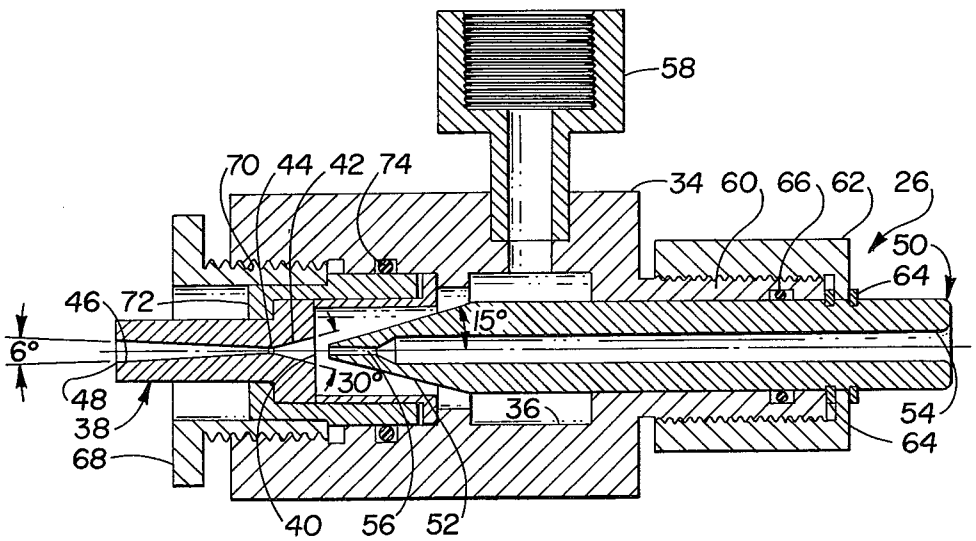
FIG. 2 is an elevational view in cross-section of a suitable air suction device that may be used in the process of this invention.

My invention involves adding along the yarn path in the draw fracturing process at a location before the air fracturing jet an air suction device 26, such as disclosed in more detail in FIG. 2. The air suction device is adjusted to create not only a suction but also a turbulent air flow within the suction device so that the trailing end of the broken filament will be intermingled and immobilized. This result is accomplished by the suction device eliminating peeling back of the trailing end while it is intermingled with its neighbor filaments by the turbulent action in the jet. In this manner, then, the broken filament becomes immobilized within the body of the yarn so as to maintain the yarn relatively intact and thus it cleanly passes through the air fracturing jet.

In reference to FIG. 2, the air suction device 26 has an elongated housing 34 provided with a central bore 36, which also defines in part a plenum chamber for receiving therein a gaseous fluid such as air.

A venturi 38 is supported in the central bore in the exit end of the housing and has a passageway extending through the venturi with a central entry opening 40 of about 6.350 mm (0.250 inch) in diameter, a converging wall portion 42 of about 30° angle, a constant diametered throat 44 of about 1.27 mm (0.050 inch), a diverging wall portion 46 and a central exit opening 48 of about 6° angle. The length of the venturi is about 47.225 mm ($1\frac{7}{8}$ inches) and the smallest outer diameter of the major portion of the venturi is about 7.938 mm (5/16 inch).

The yarn guiding needle 50 is also positioned within the central bore 32 of the housing and has an inner end portion 52 spaced closely adjacent the central entry opening 36 of the venturi 34. The yarn guiding needle has an axial yarn guiding passageway 54 of about 3.175 mm (0.125 inch) in diameter which extends through the needle and terminates in an exit opening 56 of about 0.635 mm (0.025 inch) in diameter. The outer wall of the inner end portion of the needle adjacent the exit opening 56 is inwardly tapered about 15° toward the central entry opening 40 of the venturi 38. The length of the yarn guiding needle is about 56.159 mm (2 13/64 inches) and the outer diameter is about 9.525 mm ($\frac{3}{8}$ inch).

An inlet or conduit 58 serves to introduce the gaseous treating fluid, such as air, into the plenum chamber of the central bore 36 of the housing 34.

The needle may be adjustably held in position within the central bore by means of the threaded stem 60 extending from the elongated housing 34 and an adjustment nut 62. The needle is secured to the adjustment nut by means of cooperating grooves and retaining rings 64. O-ring 66 serves as a gas seal in a known manner.

The venturi 38 may also be held in position within the elongated housing 34 by means of a threaded plug 68 cooperating with a threaded bore 70 within one end of the elongated housing and a holder 72 while an O-ring 74 provides a gas-tight seal in known manner with the holder to prevent gas from escaping from the plenum chamber.

In operating the air suction device in the process, therefore, the inlet or conduit 58 of the device is connected to a suitable source of air supply and then the device is adjusted by moving the yarn guiding needle toward and away from the venturi 38 until the device is determined to be operating under suction conditions at the central exit opening 48 of the venturi. I have found, for instance, that there is significant suction when the device is operated at about 172.379 kilopascals (25 psig) to about 1379 kilopascals (200 psig) at about 0.007 $m^3/m$ (0.25 scfm) to about 0.057 $m^3/m$ (2.00 scfm) air.

The following examples serve to illustrate the effectiveness of my process and are not intended to limit the scope of my invention.

EXAMPLE I

POY 270/(170)/30 spun as per Example 1 from U.S. Pat. No. 4,245,001.

| Draw Fracture Conditions | |
|---|---|
| Draw Ratio | 1.55:1 |
| Feed Roll Temp. | 98° C. |
| Slit Heater | 240° C. |
| Draw Roll Speed | 808 m/minute |

-continued

| Draw Fracture Conditions | |
|---|---|
| Jet* | 0.189 $m^3/m$ (6.5 scfm) at 3447.5 kilopascals (500 psig) |
| Haulout Roll Speed | 800 m/minute |
| Overfeed into jet | 1% |
| End breaks per 454 grams (per pound) | 0.042 |

*(FIG. 2 of U.S. PAT. NO. 4,095,319

When using the suction jet device prior to the fracturing jet at 0.0425 $m^3/m$ (1.5 scfm) at 1379 kilopascals (200 psig), the end break dropped to 0.014 end breaks per 454 grams (per pound).

EXAMPLE II

Same as Example I except the suction jet device was operated at about 0.014 $m^3/m$ (0.5 scfm) at 620.55 kilopascals (90 psig) with a corresponding end break per 454 grams (per pound) level of 0.020.

The invention has been described in detail with particular reference to preferred embodiments thereof, but it will be understood that variations and modifications can be effected within the spirit and scope of the invention.

I claim:

1. In a process for draw fracturing yarn comprising uniformly drawing to a preselected level of utility a yarn comprising a plurality of continuous filaments having a fracturable cross-section, fracturing the filaments by passing the yarn through an operating fluid fracturing jet, and taking up said yarn, the improvement comprising passing said yarn through a turbulent flow air suction device downstream of said drawing and upstream of said fracturing jet, the air suction device being adjusted to provide suction at the entrance thereof to intermingle and immobilize broken filaments by entangling them with unbroken filaments in the yarn and thereby reduce end breaks in the fracturing operation.

* * * * *